US005624890A

United States Patent [19]

Kagaya et al.

[11] Patent Number: 5,624,890

[45] Date of Patent: Apr. 29, 1997

[54] LUBRICATING OIL COMPOSITION FOR USE IN TWO-STROKE CYCLE CYLINDER INJECTION ENGINE

[75] Inventors: Mineo Kagaya, Yokohama; Kazuo Miyazawa, Iwata, both of Japan

[73] Assignees: Nippon Oil Company, Ltd, Tokyo-to; Yamaha Hatsudoki Kabushiki Kaisha, Iwata, both of Japan

[21] Appl. No.: 563,047

[22] Filed: Nov. 27, 1995

[30] Foreign Application Priority Data

Nov. 28, 1994 [JP] Japan ..... 6-293228

[51] Int. Cl.[6] ..... C10M 107/08

[52] U.S. Cl. ..... 508/561; 508/591; 585/12

[58] Field of Search ..... 252/43, 515 R; 585/12; 508/561, 591

[56] References Cited

U.S. PATENT DOCUMENTS

| | | | |
|---|---|---|---|
| 3,852,204 | 12/1974 | Souillard et al. | 252/33.4 |
| 3,878,115 | 4/1975 | Souillard et al. | 252/33.4 |
| 4,425,138 | 1/1984 | Davis | 252/51.5 R |
| 4,663,063 | 5/1987 | Davis | 252/51.5 A |
| 5,049,291 | 9/1991 | Miyaji et al. | 252/33 |
| 5,264,005 | 11/1993 | Blythe | 252/52 R |
| 5,321,172 | 6/1994 | Alexander et al. | 252/43 |
| 5,475,171 | 12/1995 | McMahon et al. | 44/300 |
| 5,498,353 | 3/1996 | Lin et al. | 508/591 |

*Primary Examiner*—Jerry D. Johnson

*Attorney, Agent, or Firm*—Oblon, Spivak, McClelland, Maier & Neustadt, P.C.

[57] ABSTRACT

A lubricating oil composition for two-stroke cycle cylinder injection engines contains as essential ingredients: (A): a base oil containing (1) 10–30% by mass of polybutene with number-average molecular weight 250–350 on the basis of a total amount of the base oil, (2) 30–60% by mass of polybutene with number-average molecular weight 450–550 on the basis of the total amount of the base oil, and (3) 15–40% by mass of mineral oil and/or a synthetic oil, which is other than polybutene, with kinematic viscosity 2–35 $mm^2/s$ at 100° C., on the basis of the total amount of the base oil; and (B): 2–15 parts by mass of alkylaminophenol having an alkyl group with 8–400 carbon atoms relative to 100 parts by mass of the base oil.

4 Claims, 7 Drawing Sheets

LUBRICATING OIL COMPOSITION FOR USE IN TWO-STROKE CYCLE CYLINDER INJECTION ENGINE

BACKGROUND OF THE INVENTION

The present invention relates to a lubricating oil composition for use in two-stroke cycle cylinder injection engines, to be fed directly to the suction system or lubricated parts. More specifically, the invention relates to a lubricating oil composition for use in two-stroke cycle cylinder injection engines, which is superior in piston cleanliness, ring sticking prevention, and lubricity and which yields less carbon deposition of the exhaust system.

For two-stroke cycle cylinder injection engines, for example, it is a practice to adopt a method in which lubricating oil is fed midway of the suction system so that a mixture of fuel and lubricating oil is fed to the engine, or a method in which lubricating oil is injected and fed directly to lubricated parts such as the piston sliding surface, crank journal, and the like. Whichever method is adopted, the lubricating oil will burn together with the mixed gas of fuel and air, where the resulting exhaust gas contains unburnt lubricating oil such that particulate substances composed mainly of the unburnt lubricating oil and the fuel can be viewed by the eye as exhaust smoke. To reduce this exhaust smoke, it is effective to reduce the ratio of lubricating oil to fuel (mixing ratio). Also, there have been proposed lubricating oils improved with the aim of reducing the exhaust smoke.

However, the more the mixing ratio is reduced, the more the bearings and other parts of the engine will be subject to discoloration, wear, and the like, resulting in poorer lubricity. This means that the method by reducing the mixing ratio has limitations. Also, as is the case with the two-stroke cycle cylinder injection engines, when much carbon (soot) is contained particularly in the combustion gas and besides the piston is burdened with a high thermal load, there often occur such problems as the ring sticking that carbon is deposited between piston ring and ring grooves, causing the ring to stick thereto.

SUMMARY OF THE INVENTION

The present invention has been accomplished with a view to solving the above-described disadvantages of the prior art. An object of the present invention is therefore to provide a lubricating oil composition for use in two-stroke cycle cylinder injection engines, whose constitution is improved so as to have high piston cleanliness and high lubricity, to prevent the ring sticking and the like, and to reduce the carbon deposition in the exhaust system as well as smokes.

To achieve the above object, according to the present invention, there is provided a lubricating oil composition for two-stroke cycle cylinder injection engines, the lubricating oil composition being fed directly to a suction system or lubricated parts of a two-stroke cycle cylinder injection engine which has a backflow prevention reed valve provided on a suction passage connected to a crank chamber and which is so arranged that air sucked into the crank chamber is fed, under primary compression, to a combustion chamber via a scavenging passage, the lubricating oil being characterized by comprising as essential ingredients:

(A): a base oil containing (1) 10–30% by mass of polybutene with number-average molecular weight 250–350 on the basis of a total amount of the base oil, (2) 30–60% by mass of polybutene with number-average molecular weight 450–550 on the basis of the total amount of the base oil, and (3) 15–40% by mass of mineral oil and/or a synthetic oil, which is other than polybutene, with kinematic viscosity 2–35 $mm^2/s$ at 100° C., on the basis of the total amount of the base oil; and (B): 2–15 parts by mass of alkylaminophenol having an alkyl group with 8–400 carbon atoms relative to 100 parts by mass of the base oil.

With the above constitution, the lubricating oil composition for two-stroke cycle cylinder injection engines according to the present invention can be improved in such properties as the piston cleanliness, piston ring sticking prevention, and lubricity, and can be reduced in carbon deposition in the exhaust system, advantageously.

DISCLOSURE OF THE INVENTION

The cylinder injection engine herein refers to engines in which fuel is injected directly into cylinders, including both types of cylinder injection engines and gasoline engines.

The constitution of the lubricating oil composition is specifically defined to the above scope in the present invention due to the reasons as described below.

Polybutene herein refers to copolymerized substances usually obtained by cation-polymerizing, with a catalyst such as aluminium chloride, which is a Friedel-Crafts' catalyst, a butane-butene fraction that is the remaining fraction resulting from extracting butadiene from $C_4$ fractions generated in the process of producing ethylene or propylene by naphtha cracking, or saturated such copolymerized substances obtained by hydrogenating their double bonds. The butane-butene fraction herein refers to one containing isobutane, n-butane, isobutylene, 1-butene, trans-2-butene, cis-2-butene, and the like.

Component (1) is polybutene with number-average molecular weight 250–350, preferably 300–350. Polybutenes out of this range of number-average molecular weight are undesirable, because they would result in a poor suppression of carbon deposits to the piston ring grooves, giving rise to a ring sticking.

The blending amount of Component (1) is 10–30% by mass, preferably 15–25% by mass, on the basis of the total amount of base oil. Blending amounts less than 10% by mass would result in a poor prevention of ring sticking, and those over 30% by mass would result in insufficient lubricity such that the bearings and others of the engine are subject to discoloration and wear. Therefore, both of the blending amounts are undesirable.

Component (2) is polybutene with number-average molecular weight 450–550, preferably 480–530. Less than 450 number-average molecular weights are undesirable because of insufficient lubricity of the engine. On the other hand, higher than 550 number-average molecular weights are also undesirable because of the fears for deterioration in the piston cleanliness and increase in the carbon deposition of the exhaust system.

The blending amount of Component (2) is 30–60% by mass, preferably 40–55% by mass on the basis of the total amount of base oil. Blending amounts less than 30% by mass would result in poor lubricity, exhaust system deposits prevention, and the like, and are therefore undesirable. On the other hand, blending amounts over 55% by mass would result in deteriorated lubricity such that the small end of connecting rod and the crank bearings would be subject to discoloration, wear, and the like, and are therefore undesirable.

Component (3) is a mineral oil and/or synthetic oil except polybutene with a kinematic viscosity at 100° C. of 2–35

$mm^2/s$, preferably 3–20 $mm^2/s$. Kinematic viscosities less than 2 $mm^2/s$ would cause deteriorations of the lubricity for the piston, cylinder, small end of connecting rod, and crank bearings, and are therefore undesirable. On the other hand, kinematic viscosities over 35 $mm^2/s$ would cause the generation of carbon deposition to the exhaust system, and are thus undesirable.

The mineral oil herein refers to paraffin, naphthene, or other mineral oil base lubricating oils obtained by refining lubricating oil distillates resulting from the atmospheric distillation and vacuum distillation of crude oil, through the refining processes of solvent deasphalting, solvent extraction, hydrocracking, solvent dewaxing, contact dewaxing, hydrorefining, sulfate cleaning, clay treatment and the like, in combinations as required.

Further, the pour point of mineral oil herein referred to, although not particularly limitative, is desirably below −10° C., preferably below −15° C.

Synthetic oils other than polybutene herein are exemplified by polyα-olefins (1-octene oligomers, 1-decene oligomers, etc.) other than polybutene, diesters (ditridecyl glutalate di-2-ethylhexyl adipate, diisodecyl adipate, ditridecyl adipate, di-3-ethylhexyl sebacate, etc.), polyolesters (trimethylolpropane caprylate, trimethylolpropane pelargonate, pentaerythritol2-ethylhexanoate, pentaerythritol pelargonate, etc.), or mixtures of two or more of these compounds. Any of these may be preferably used, and among others, diesters, polyolesters, and the like are particularly preferably used.

The blending amount of Component (3) is 15–40% by mass, preferably 15–30% by mass on the basis of the total amount of base oil. Blending amounts less than 15% by mass would cause deteriorations of lubricity for the small end of connecting rod and the crank bearings, and are therefore undesirable. Also, those over 40% by mass may result in problems such as carbon deposition to the exhaust system, piston ring sticking, and piston cleanliness deterioration, and are thus undesirable.

Further, when a hydrocarbon solvent is contained in the base oil as herein defined, the effect of reducing exhaust smokes can be further enhanced. Generally, the boiling point under normal pressure of the hydrocarbon solvent is desirably 150°–350° C., preferably 170°–300° C., more preferably 170°–260° C. The hydrocarbon solvent is a solvent of at least one kind selected from a group consisting of petroleum solvents and synthetic hydrocarbon solvents.

As the petroleum hydrocarbon solvent, available are paraffin, naphthene, aromatic petroleum hydrocarbon solvents, which are exemplified by n-paraffin, Stoddard solvent, mineral spirits, and kerosine. Among others, paraffin or naphthene base petroleum hydrocarbon solvents, such as kerosine, are preferable by virtue of their superior exhaust smoke reducing effect.

The synthetic hydrocarbon solvent can be exemplified by propylene with number-average molecular weight 120–300, butene with number-average molecular weight 120–250 or less, low polymers of isobuthylene, or hydrides of these compounds. Blending amounts less than 1% by mass of the hydrocarbon solvent as defined herein would result in insufficient improvement in the exhaust smoke reduction effect attributable to the content of hydrocarbon solvent. Also, its contents over 25% by mass would cause the lubricity to deteriorate, such that the frictional loss of the piston and the small end of connecting rod would increase, and are thus undesirable.

Component (4), alkylaminophenol, refers to a compound represented by the following chemical formula (1):

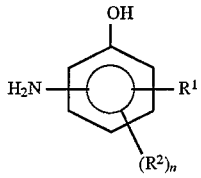

(1)

wherein $R^1$ denotes a straight-chain or branched alkyl group with 8–400 carbon atoms, preferably 12–300 carbon atoms, which is, in general, preferably one derived from homopolymers or copolymers of monoolefin with 2–10 carbon atoms. The monoolefin with 2–10 carbon atoms here referred to may be either straight-chain or branched, and is exemplified by ethylene, propylene, 1-butene, 2-butene, isobutene, 1-pentene, 1-hexene, 1-heptene, 1-octene, 1-nonene, 1-decene, and the like. Among these, $R^1$ is more preferably one derived from homopolymers or copolymers of propylene and isobutene in terms of cleanliness enhancement effect, and particularly preferably one derived from homopolymers of isobutene.

Also, $R^2$ in the above chemical formula (1) denotes an alkyl group with 1–3 carbon atoms. The alkyl group with 1–3 carbon atoms here referred to is exemplified by a methyl group, ethyl group, n-propyl group, and isopropyl group, where the methyl group is generally preferable in terms of high availability of material.

Also, n in the chemical formula denotes a number, 0 or 1, where 0 is generally preferable from a good availability of material.

Alkylaminophenol, which is Component (4) of the present invention and represented by the chemical formula (1), is not limitative in its fabricating method, and any alkylaminophenol, only if its structure is represented by the chemical formula (1), is usable irrespectively of its fabricating method. Generally, this alkylaminophenol can be fabricated through steps of first alkylating phenol (or a short-chain alkylphenol having an $R^2$ group such as cresol) with homopolymers or copolymers of monoolefin serving as the material of $R^1$, by using an alkylating catalyst such as boron trifluoride or active clay, then nitrating the resulting alkylphenol with a nitrating agent such as nitric acid, and thereafter reducing the resulting alkylnitrophenol with a reducing agent such as hydrogen to covert the nitro group to amino group.

The blending amount of Component (4) is 2–15 parts by mass, preferably 5–10 parts by mass, relative to 100 parts by mass of base oil. Blending amounts less than 2 parts by mass would result in shortage of ring sticking prevention and piston cleanliness, and are therefore undesirable. Also, blending amounts over 15 parts by mass could not attain enhancement effects of ring sticking prevention and piston cleanliness comparable to the blending amounts, and are thus undesirable because of the economic disadvantage.

For the lubricating oil composition of the present invention, known additives may be used as required to further enhance its superior performance. These additives are exemplified by cleaning dispersants such as alkaline earth metal sulfonate, alkaline earth metal phenate, alkaline earth metal salicylate, alkenyl imide succinate, polybutenyl amine, and benzyl amine, pour point depressants such as polymethacrylate, rust preventives such as polyether and ester ones, anti-foaming agents such as methyl silicone, dimethyl silicone, and fluorosilicone, and the like. The addition amounts of these various additives are arbitrary, but an addition amount of 0.001–0.01 parts by mass, preferably 0.002–0.005 parts by mass is desirable for anti-foaming agents, and that of 0.05–10 parts by mass, preferably 0.1–5 parts by mass is desirable for the other additives.

Hereinafter, the construction of a two-stroke cycle cylinder injection engine to which the lubricating oil composition of the present invention is applied is explained with reference to FIGS. 1 through 7. FIG. 1 is a sectional front view of the engine, FIG. 2 is a sectional side view thereof, FIGS. 3 and 4 are sectional views taken along the lines III—III and IV—IV of FIG. 1, respectively, FIG. 5 is a sectional side view of the piston, FIG. 6 is an enlarged sectional view of the piston ring portion, and FIG. 7 is an arrangement view of a lubricating oil feeding apparatus.

In these figures, designated by reference numeral 1 is a water-cooled parallel three-cylinder crank-chamber compression two-stroke cycle cylinder injection engine, which has a crankcase 3 fitted to the lower mating surface 2*a* of a cylinder block 2 of the engine 1, and three sets of crank chambers 4 made up of lower part of the cylinder block 2 and the crankcase 3 for the individual cylinders. Further, a cylinder head 5 is placed on the upper mating surface 2*b* of the cylinder block 2, and securely tightened by a large number of head bolts 6.

The cylinder block 2 has three cylinder bores 2*c* formed in parallel, and a piston 7 is slidably inserted into each of the cylinder bores 2*c*. A space surrounded by the top surface of the piston 7, a mating surface 5*a* of the cylinder head 5, the cylinder bores 2*c*, and the bottom surface of a later-described hot plug 21 serves as a main combustion chamber 8. Further, a smaller end portion 9*a* of a con'rod 9 is connected to the piston 7 via a piston pin 10 and a needle bearing 11, while a larger end portion 9*b* of the con'rod 9 is connected to a crank pin 13 of the crankshaft 12 via a needle bearing 14.

The crankshaft 12 is supported by a ball bearing 46 and a roller bearing 39. The roller bearing 39 supporting the gap between cylinders of the crankshaft 12 is fed with lubricating oil directly from a first lubricating oil 45*a* as described later. The bearing 14 of the crank pin 13 of the crankshaft 12 is fed with the lubricating oil that has been fed to the roller bearing 39, via an oil intake passage 13*a* and a branch passage 13*b* by centrifugal force.

At lower part of the cylinder block 2, three suction openings 15*a* are formed so as to communicate with the crank chambers 4, and a suction manifold 16*a* common to all the cylinders is connected to each of the suction openings 15*a*. Further, each crank chamber 4 and the suction manifold 16*a* are communicated with each other via an oil return hole 51, which is opened at the bottom of each crank chamber 4, as well as via a hose 52. Thus, the oil accumulated in the crank chambers 4 is returned to within the suction manifold 16*a*.

A reed valve 17 is provided to each suction opening 15*a*. This reed valve 17 is so constructed as to open and close an opening 17*b* formed in a valve body 17*a*, with a valve plate 17*c*. This reed valve 17 automatically opens to thereby introduce air into the crank chambers 4 when the interior of the crank chambers 4 come into negative pressure with an up stroke of the piston 7, and closes to prevent air blow-back when the crank chambers 4 come into positive pressure with a down stroke of the piston 7.

On the opposite side to the suction openings 15*a* of the cylinder block 2, a scavenging adjustment opening 15*b* is formed so as to communicate with each crank chamber 4. A common scavenging chamber 16*b* is connected to each scavenging adjustment opening 15*b*, and a scavenging control valve 16*c* is disposed at the connection opening portion of the scavenging chamber 16*b*. When the scavenging control valve 16*c* is opened, the crank chambers 4 communicating with the connection opening come to communicate with the interior of the scavenging chamber 16*b* so that the volume of the crank chamber is substantially enlarged, causing the scavenging pressure to lower and the inner EGR gas to increase, with the result that the combustion temperature is lowered. On the other hand, when the scavenging control valve 16*c* is closed, the crank chamber turns to the normal crank chamber volume, causing the primary compression pressure to elevate, so that a sufficient scavenging is accomplished.

At upper part of the cylinder block 2, a set of exhaust ports 18 are formed for each of the cylinders. These exhaust ports 18 each comprises a main exhaust port 18*b* for leading a main exhaust hole 18*a* to the cylinder outside connection hole, and sub-exhaust ports 18*d* for leading a pair of sub-exhaust holes 18*c* opened to the upper side of the main exhaust hole 18*a* and for joining them to the main exhaust port 18*b* midway.

Each sub-exhaust port 18*d* is controlled for its opening and closing by an exhaust control unit 19. This exhaust control unit 19 is designed to vary the exhaust timing and compression ratio, and is insertedly disposed so as to cross the sub-exhaust ports 18*d* of the cylinder block 2. The exhaust control unit 19 comprises three exhaust valve bodies 19*a* for opening and closing the sub-exhaust ports 18*d*, and a drive mechanism 19*b* for driving the exhaust valve bodies 19*a* for their opening and closing. The exhaust valve bodies 19*a* are each composed of a round rod and an arch-shaped valve part fitted thereto, and are connected to one another by engaging portions, respectively. The drive mechanism 19*b* is so constructed that the drive shaft is connected to the outer end portions of the exhaust valve bodies 19*a*, and a drive motor is connected to the drive shaft via a gear train.

A pair of main scavenging holes 18*e* are formed on both sides of the main exhaust hole 18*a* of the cylinder block 2, and an opposite scavenging hole 18*f* is formed at a position opposite to the main exhaust hole 18*a*. These scavenging holes 18*e*, 18*f* communicate with the cylinder-use crank chambers 4 via scavenging ports.

In the cylinder block 2, oil holes 2*e*, 2*f* for feeding lubricating oil to the piston sliding surface are provided each in a pair to each cylinder. The oil holes 2*e*, 2*f* are bored through the cylinder block 2 in a direction perpendicular to the crankshaft, and are located so as to be shifted toward the crankshaft with its cylinder axis A interposed therebetween as viewed in the direction of the cylinder axis A (see FIG. 4), and to be positioned between piston rings of the piston 7 located at the lower dead point as viewed in the crankshaft direction (see FIG. 1). Then, the oil holes 2*e*, 2*f* are connected to a second lubricating oil pump 45*b* via an oil feed passage 41.

Further, a box-shaped boss 3*b* opened at its lower side is protrudingly provided on the peripheral edge of a bottom wall 3*a* of the crankcase 3, and a balancer chamber 27 is formed by fitting to the boss 3*b* a box-shaped balancer cover 26 opened at its upper side. Within this balancer chamber 27, a balancer shaft 28 is disposed in parallel with the crankshaft 12, and its both ends are supported by the mating surfaces of the boss 3*b* and the balancer cover 26 via a bearing 29.

An end of the balancer shaft 28 is protruded outward of the balancer chamber 27, and the protruding portion is rotationally driven by the crankshaft 12 at the same speed and in opposite directions via gears 30*a*, 30*b*. These gears 30*a*, 30*b* are located within a gear chamber 32 defined by surrounding the end faces of the cylinder block 2, crankcase 3, and balancer cover 26 with a gear cover 31. The gear chamber 32 is communicated with the balancer chamber 27 by upper and lower communicating holes 27*a*, 27*b*.

A sub-combustion chamber 22 is formed at the mating surface 5*a* of cylinder head 5. This sub-combustion chamber 22 comprises a recess 21*a* of the hot plug 21 inserted into a plug retainer hole 20*a* of the cylinder head 5, and a recess 20*b* formed in the cylinder head 5. The sub-combustion chamber 22 is communicated with the main combustion chamber 8 via a communicating hole 21*b*. In addition, designated by reference numeral 23 is a bolt 23 for fixing the hot plug 21, and the bolt 23 is penetrated to the top surface of the cylinder head 5 and securely tightened by a nut. Numeral 25*a* denotes a fuel injection valve, and 25*b* denotes a glow plug.

In general, the cylinder injection engine has no throttle valves so that the suction negative pressure for a brake master back 35 is insufficient. Thus, in the present engine, a vane pump (vacuum pump) 34*b* for generating negative pressure is provided coaxially with an alternator 34*a* driven by the crankshaft. The vane pump 34*b* is fed with lubricating oil from an oil pump 36 provided independently of the aforementioned lubricating oil pumps 45*a*, 45*b*.

Therefore, a mixture of the air sucked from the brake master back 35 and the lubricating oil is generated. As a result, the balancer chamber 27 is used also as a breather chamber for separating the lubricating oil from the mixture. For this purpose, the discharge hole of the vane pump 34*b* is communicatedly connected to the gear chamber 32 by a mixture passage 37, and the return hole formed at the oil sump portion of the gear chamber 32 is connected to the oil pump 36 by an oil passage 38.

Out of the mixture discharged from the vane pump 34*b*, first, its most part of lubricating oil is fallen and separated in the gear chamber 32, and then the mixture with the remaining lubricating oil mixed is flowed into the balancer chamber 27 via the upper communicating hole 27*a*, where the lubricating oil is fallen and separated, returning to the oil sump portion of the gear chamber 32 through the lower communicating hole 27*b* and the like. In addition, the air left after the lubricating oil has been separated is fed into the suction manifold 16*a* through an air exhaust hole 27*c* via an unshown breather hose, or discharged into the atmosphere.

As for the structure of the engine, the present engine is constructed in the following manner with a view to the enhancement in the piston cleanliness, ring sticking prevention, and lubricity.

The cylinder block 2 is made from aluminium alloy castings, and has a chrome plated layer 2*c'* formed on the inner surface of the cylinder bores 2*c* of the cylinder block 2.

The piston 7 is made from aluminium alloy castings or aluminium alloy forgings, and has a Sn plated layer 7*a* formed on the outer peripheral surface of the skirt portion of the piston 7, and a nickel plated layer 7*b* formed on the top surface. Also, Kasima coat layers (hard Alumite processed layers containing molybdenum disulfate) 7*e*, 7*f* are formed on the inner surfaces of the ring groove 7*c* and piston hole 7*d* of the piston 7, respectively.

The piston ring 50 fitted to the ring groove 7*c* of the piston 7 is made of spherical graphite castings, and has a chrome plated layer 50*a* formed on its outer peripheral surface, a resin coating layer 50*b* formed on an end surface (lower end surface) on the crankshaft side, and a phosphate coating 50*c* formed o the inner peripheral surface and an end surface on the combustion chamber side.

The present engine 1 is also provided with a lubricating oil feeding apparatus 61 as shown in FIG. 7. This lubricating oil feeding apparatus 61 comprises a first lubricating oil pump 45*a* for feeding lubricating oil to the journal of the crankshaft 12, a second lubricating oil pump 45*b* for feeding lubricating oil to the cylinder sliding surface, and an ECU 42 for controlling the operation of the two pumps 45*a*, 45*b*. In addition, reference numeral 62 denotes an engine speed detection sensor for detecting the rotational speed of the crankshaft 12, 63 denotes a clutch, 64 denotes a speed change gear, and 65 denotes a lubricating oil tank.

The first and second lubricating oil pumps 45*a*, 45*b* are rotationally driven independently of the rotation of the engine by, for example, a pulse motor, and can be varied in the discharge (oil feed) amount of one cycle and the discharge time interval.

Also, the ECU 42 functions as a consumption calculating means 42*a*, a totalizing means 42*b*, and an oil feed control means 42*c*.

The consumption calculating means 42*a* estimates a lubricating oil amount (unit demand) p demanded for the crank journal for each one rotation of the engine under its running, and a lubricating oil amount (unit demand) q demanded for the piston sliding surface, based on an engine speed signal "a" derived from the engine speed detection sensor 62, a load signal "b", and an engine running time totalization signal "c". It is noted that the load signal "b" is detected based on the amount of fuel injection from the fuel injection valve 25*a*, the extent of accelerator stamping, and the like.

The totalizing means 42*b* determines totalized demands P, Q by totalizing calculated unit demands p, q of individual time points. Then, the oil feed control means 42*c* outputs drive signals A, B to the pulse motors of the first and second lubricating oil pumps 45*a*, 45*b* at a time point when the totalized lubricating oil demands P, Q have reached one-cycle discharge amounts P', Q' for the first and second lubricating oil pumps 45*a*, 45*b*.

In the engine 1, a lubricating oil demand map is searched based on the engine speed signal "a" and the load signal "b", whereby the lubricating oil demands p, q for each one rotation of the engine are determined. Then, through the totalization of the lubricating oil demands of varying time points, at the time point when the totalized demands P, Q have reached the one-cycle discharge amounts P', Q' for the first and second lubricating oil pumps 45*a*, 45*b*, the pulse motors are activated so that the lubricating oil of P', Q' is fed to the crank journal and the piston sliding surface via the oil feed passages 41*a*, 41*b*.

In this way, it is arranged that the demands p, q that will vary with time depending on the running state of the engine 1 are calculated and totalized, so that lubricating oil is fed when the totalized demands P, Q have reached the discharge amounts P', Q' for one pump cycle. Thus, lubricating oil in appropriate amounts can be fed to the lubricated parts without any excess or shortage, so that the lubricating oil consumption and the amount of smoke generation can be reduced.

Further, the top surface of the piston 7 and the outer peripheral surface of the skirt portion are coated with the Sn plated layer 7*a*, the top surface is coated with the Ni plated layer 7*b*, and the ring groove 7*c* and the piston pin hole 7*d* are coated with the Kasima coats 7*e*, 7*f*, while the lower end surface of the piston ring 50 is coated with the resin coating layer 50*b*. Thus, the piston ring sticking, the aluminium coagulation of the piston ring, and troubles around the small end of connecting rod can be avoided.

Furthermore, in the engine 1, operational faults of the reed valve 17 and the exhaust control valve 19*a* can be suppressed. More specifically, in the case of a crank chamber compression two-cycle engine in which lubricating oil is fed to the connecting rod bearings, the piston sliding surface, and the like, as in the present engine 1, the lubricating oil is mixed with suction air in the crank chamber 4, fed to the combustion chamber 8, where it burns together with the fuel. As a result, there arises a fear that the exhaust gas contains a relatively large amount of carbon, such that the reed valve 17 may malfunction due to the carbon contained in the blow-off by-gas that has invaded into the crank chamber 4, or that the exhaust control valve 19*a* may malfunction due to the carbon in the exhaust gas. However, since the lubricating oil of the present engine 1 generates less carbon as described later, the amount of carbon deposition to the reed valve 17 and the exhaust control valve 19*a* can be reduced, so that malfunction of these valves 17, 19*a* can be suppressed.

DETAILED DESCRIPTION OF THE PREFERRED EMBODIMENTS

Figure 1:
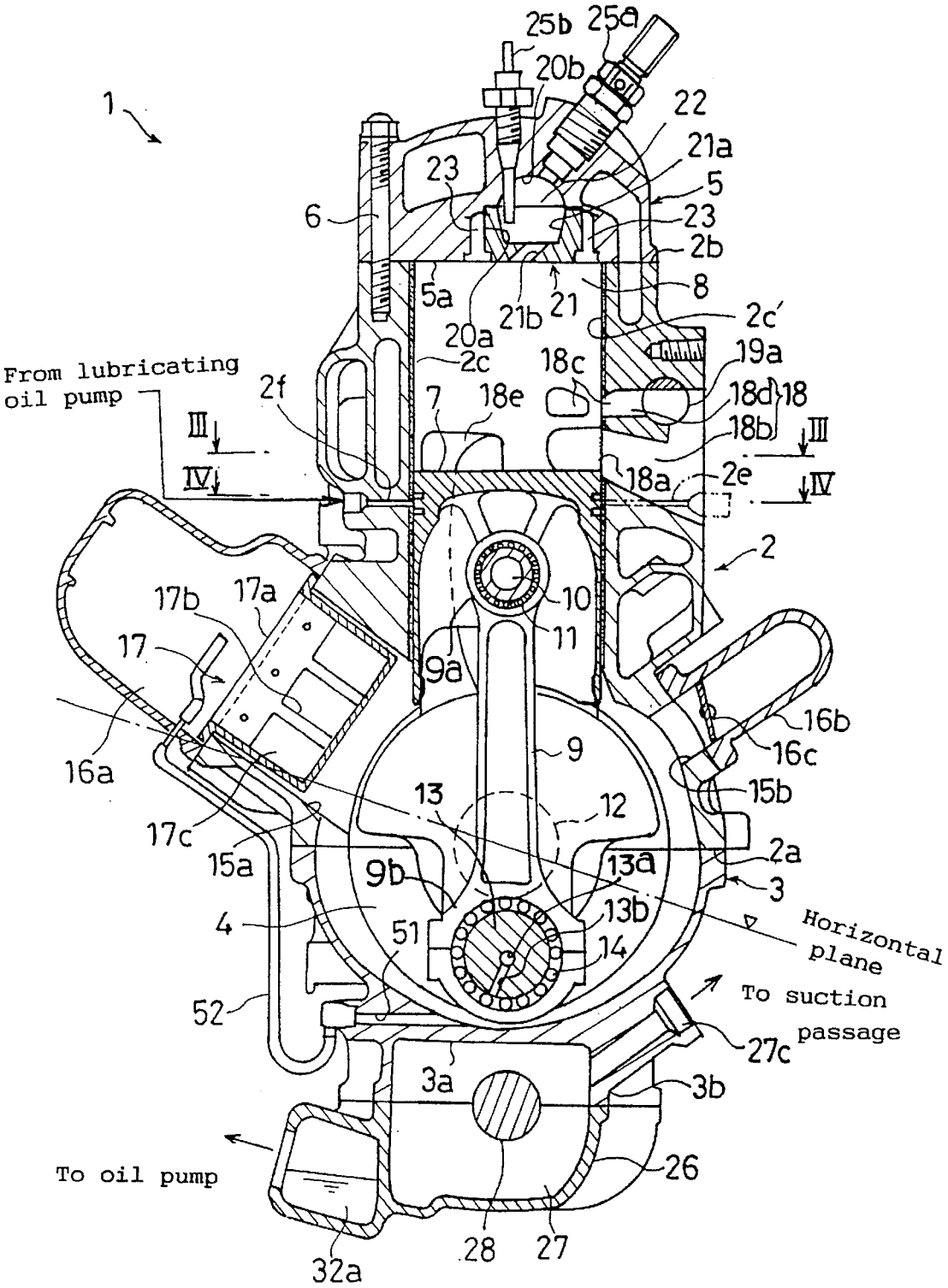
FIG. 1 is a sectional front view of a two-stroke cycle cylinder injection engine to which a lubricating oil composition of the present invention is applied.
Figure 2:
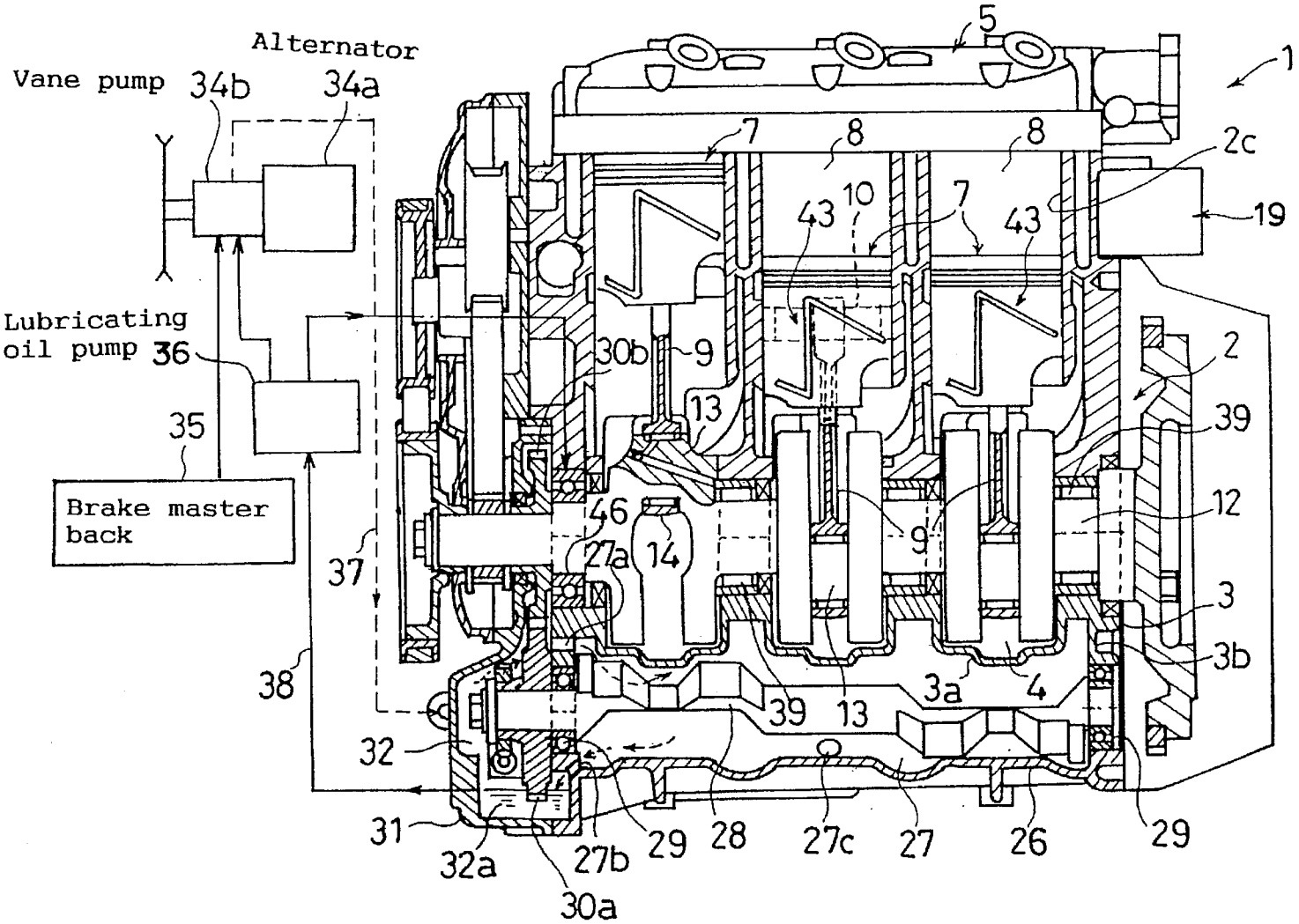
FIG. 2 is a sectional side view of the engine.
Figure 3:
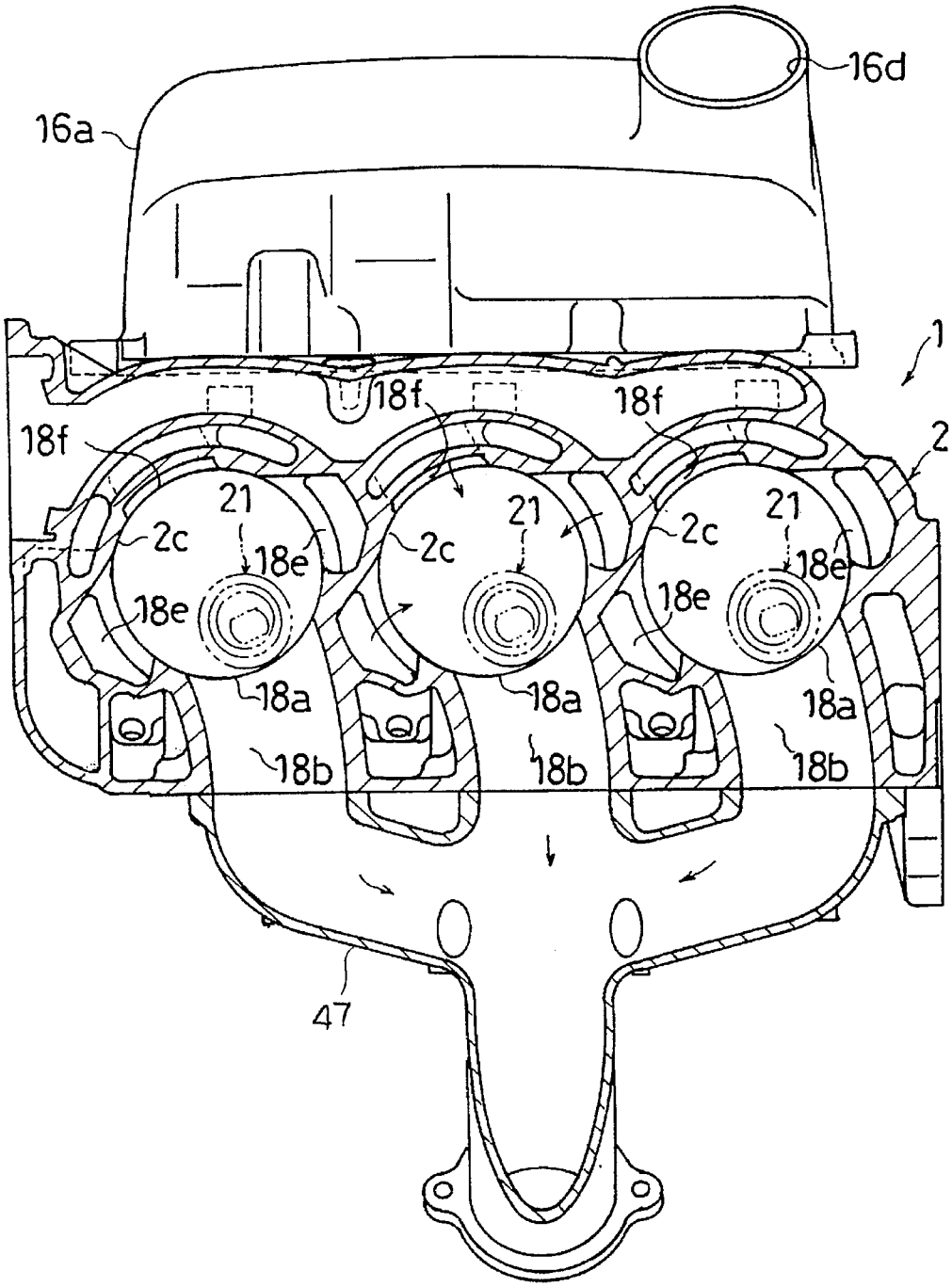
FIG. 3 is a sectional plan view of the engine taken along the line III—III of FIG. 1.
Figure 4:
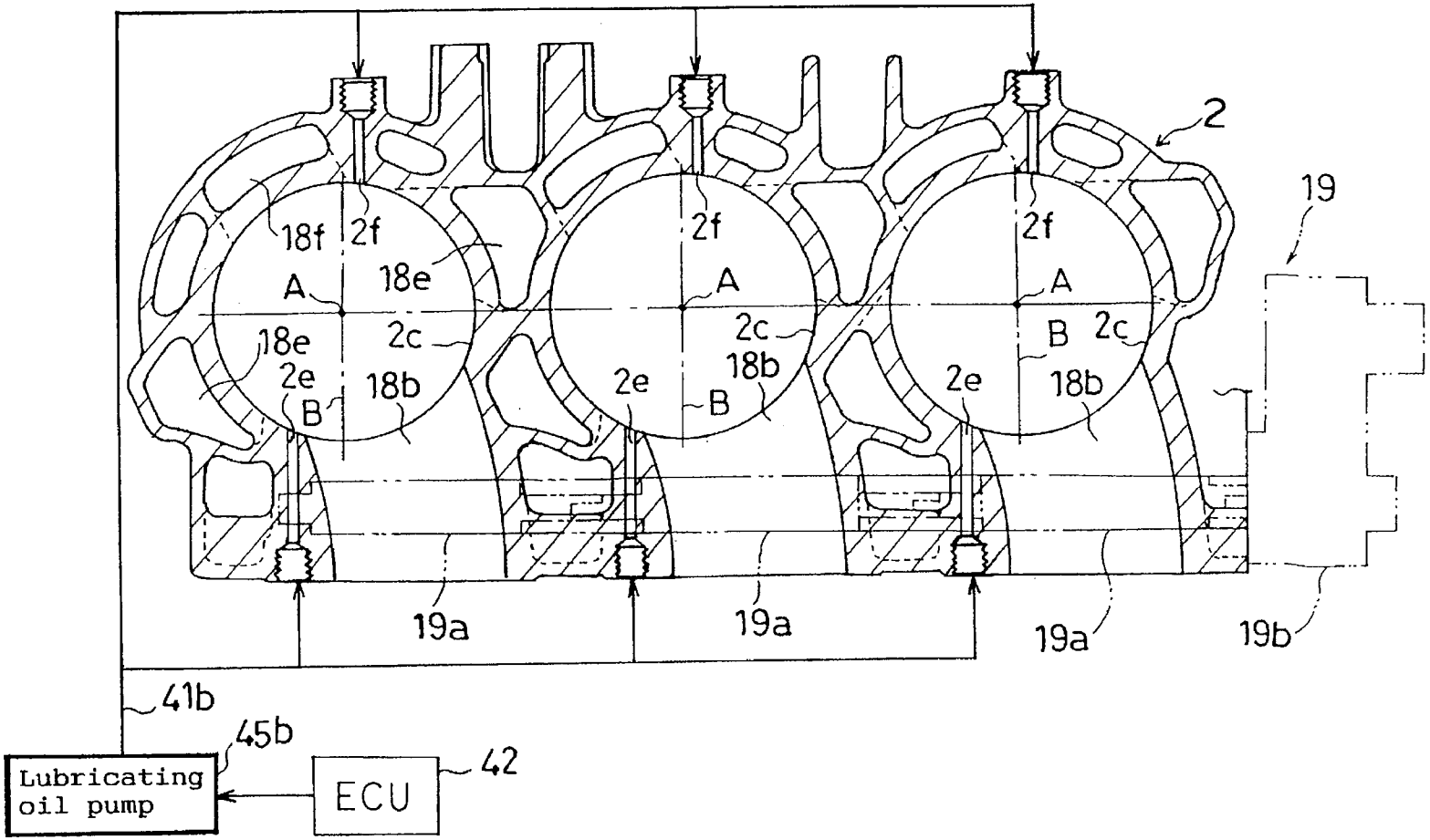
FIG. 4 is a sectional plan view of the engine taken along the line IV—IV of FIG. 1.
Figure 5:
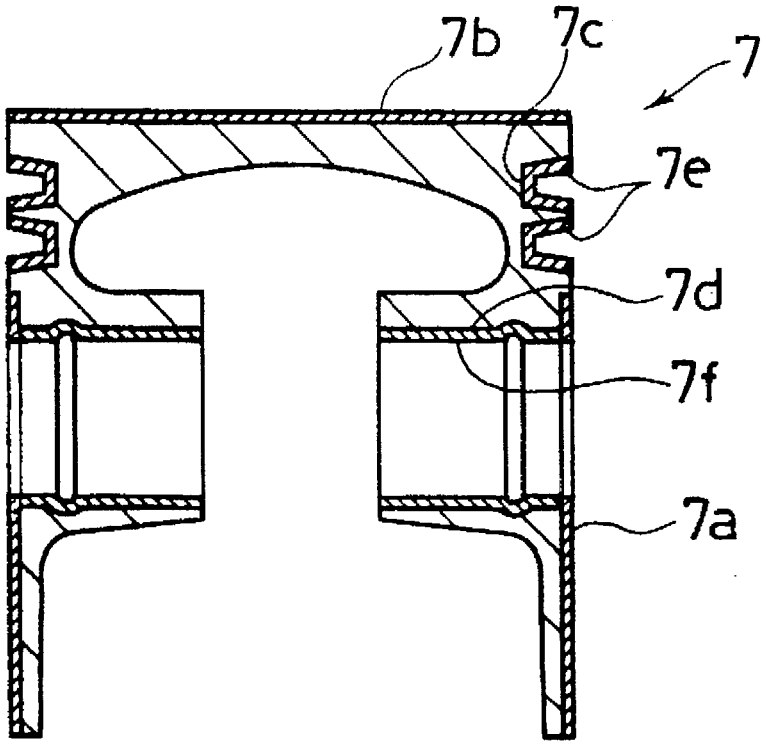
FIG. 5 is a sectional side view of the piston of the engine.
Figure 6:
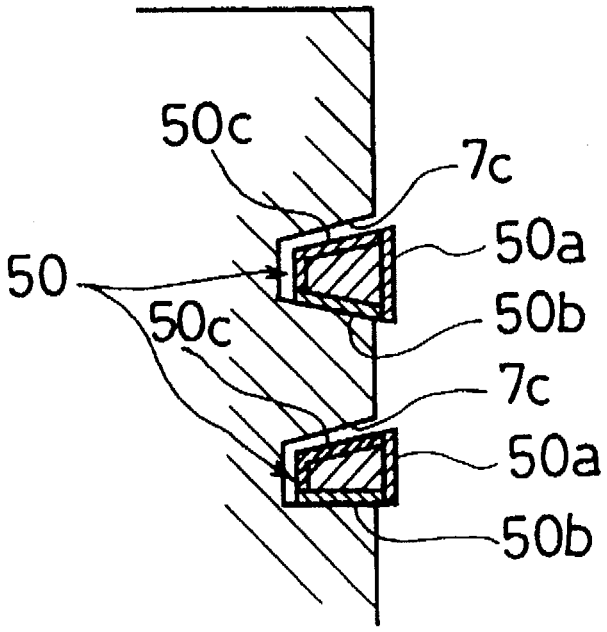
FIG. 6 is an enlarged sectional view of the piston ring portion of the engine.
Figure 7:
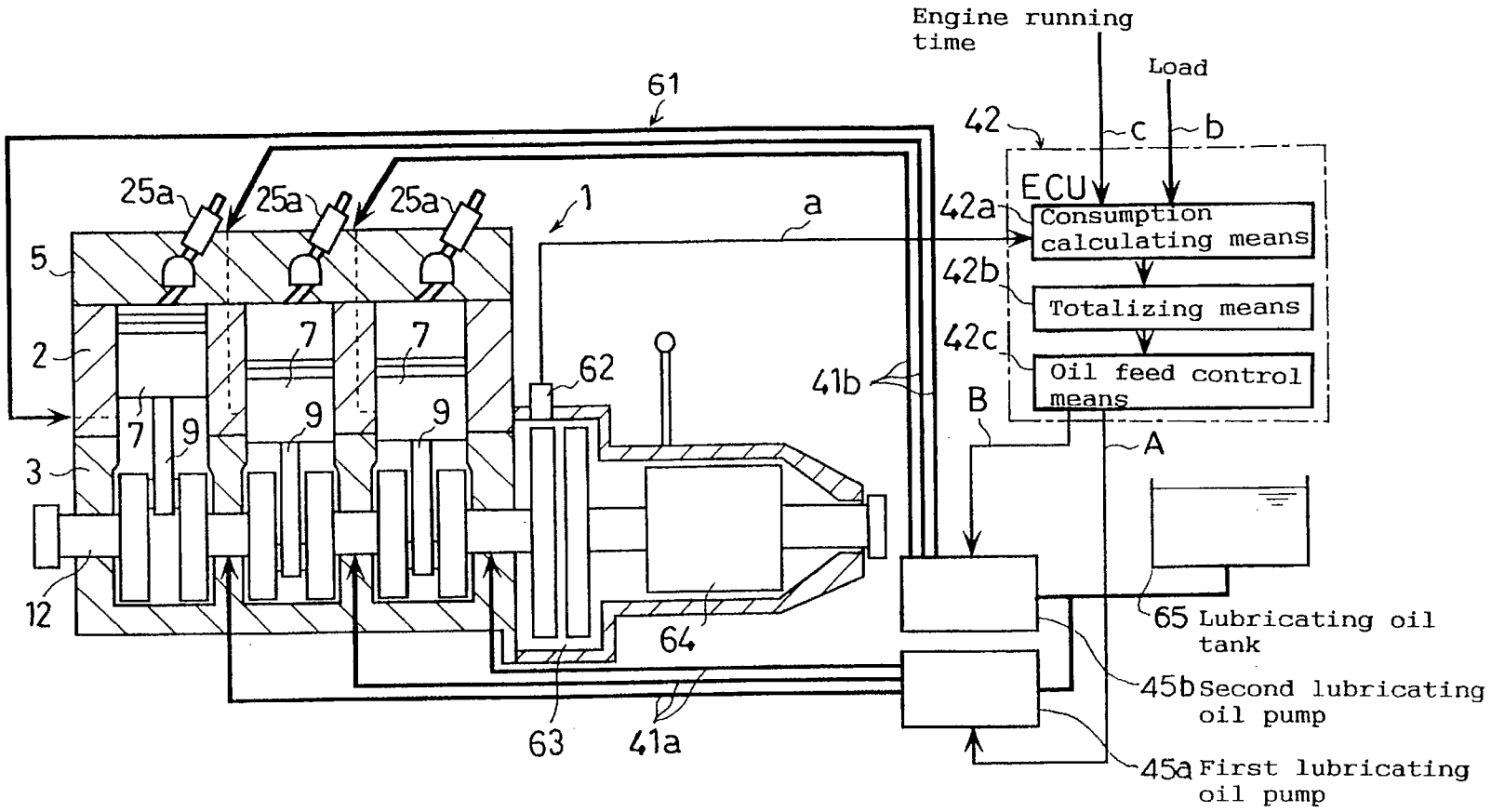
FIG. 7 is a general arrangement view of the lubricating oil feeding apparatus of the engine.

The present invention will now be described in more detail in conjunction with examples and comparative examples thereof, but the present invention should not be construed as being limited to these examples.

[Examples 1–8 and Comparative Examples 1–10]

In the crank-chamber compression type two-stroke cycle cylinder injection engine 1 having the above-described construction, with the use of lubricating oil compositions for two-stroke cycle cylinder injection engines according to the present invention as shown in Table 1 (Example 1–8), exhaust system carbon deposition, ring sticking, and the like obtained through tests were evaluated in five ranks of 1 to 5. Their results are shown in Table 1. Also for comparison, similar evaluation was carried out with compositions having the constitutions as shown in Table 1 (Comparative Example 1–5) and commercially available engine oils (Comparative Examples 6–10). Their results are also shown in Table 1.

It is noted that the running conditions of the engine 1 and the evaluation criteria are as shown below:

[Construction and Running Conditions of Engine]

Displacement: 400 cc

Engine type: Crank-chamber compression type two-stroke cycle cylinder injection engine Combustion chamber configuration: Vortex flow chamber type combustion chamber Ignition: Compression ignition Engine speed: 5000 rpm Output: 20 PS Running time: 2 hours

[Evaluation Criteria]

Exhaust System Carbon Deposition

| Rank | Evaluation criteria (deposition level at cylinder exhaust port) |
|---|---|
| 5 | Very low |
| 4 | Low |
| 3 | Middle |
| 2 | Rather high |
| 1 | High |

Piston Ring Sticking

| Rank | Evaluation criteria |
|---|---|
| 5 | No |
| 4 | Less than 10% sticking |
| 3 | 10% - less than 30% sticking |
| 2 | 30% - less than 50% sticking |
| 1 | Sticking |

Piston Cleanliness

| Rank | Evaluation criteria (sticking level of varnish and carbon) |
|---|---|
| 5 | Very low |
| 4 | Low |
| 3 | Middle |
| 2 | Rather high |
| 1 | High |

Small End of Connecting Rod Lubricity

| Rank | Evaluation criteria (discoloration and wear) |
|---|---|
| 5 | No |
| 4 | Light, partial discoloration |
| 3 | Light, wide discoloration |
| 2 | Heavy discoloration |
| 1 | Light wear |

Crankshaft Lubricity

| Rank | Evaluation criteria (discoloration and wear) |
|---|---|
| 5 | No |
| 4 | Light, partial discoloration |
| 3 | Light, wide discoloration |
| 2 | Heavy discoloration |
| 1 | Light wear |

Smoke

| Rank | Evaluation criteria (smoke level) |
|---|---|
| 5 | No |
| 4 | Very low |
| 3 | Low |
| 2 | High |
| 1 | Very high |

Also, the components used in Table 1 are as follows:

Component (1)

A: polybutene with number-average molecular weight 330

Component (2)

A: polybutene with number-average molecular weight 510

Component (3)

A: paraffin refined mineral oil with kinematic viscosity 5.0 $mm^2/s$ (at 100° C.)

B: trimethylolpropanetricaprylate

C: 1-deceneoligomer with kinematic viscosity 5.0 $mm^2/s$ (at 100° C.)

Hydrocarbon Solvent

A: paraffin petroleum base hydrocarbon solvent with boiling point range 170°–260° C.

Other Additives

A: An additive package containing Ca base cleaning agents, phenol antioxidants

B: Polybutenyl imide succinate base ashless dispersants

C: Amino-amide base ashless dispersants

TABLE 1

| | Constitution of base oil (% by mass on base oil basis) | | | | Additives (parts by mass relative to 100 parts by mass of base oil) | | Results of engine tests (evaluated in five ranking steps of 5 (best) to 1) | | | | | |
|---|---|---|---|---|---|---|---|---|---|---|---|---|
| | Component (1) | Component (2) | Component (3) | Hydrocarbon solvent | Component (4) | Other additives | Exhaust system carbon deposition | Piston ring sticking | Piston cleanliness | Small end of Con'rod lubricity | Crank bearing lubricity | Smoke |
| Ex. | | | | | | | | | | | | |
| 1 | A (30) | A (55) | A (15) | — | A (7.0) | A (2.0) | 4 | 5 | 5 | 4 | 4 | 4 |
| 2 | A (20) | A (50) | A (25) | A (5) | A (7.0) | A (2.0) | 4 | 5 | 5 | 5 | 5 | 4 |
| 3 | A (20) | A (50) | A (25) | A (5) | A (3.0) | A (2.0) | 4 | 4 | 4 | 5 | 5 | 4 |
| 4 | A (20) | A (50) | B (25) | A (5) | A (7.0) | A (2.0) | 4 | 5 | 4 | 5 | 5 | 4 |
| 5 | A (20) | A (50) | C (25) | A (5) | A (7.0) | A (2.0) | 4 | 5 | 4 | 5 | 5 | 4 |
| 6 | A (20) | A (50) | A (25) B (10) | A (5) | A (7.0) | A (2.0) | 4 | 5 | 5 | 5 | 5 | 4 |
| 7 | A (10) | A (50) | A (17) | A (23) | A (10.0) | A (2.0) | 5 | 5 | 5 | 4 | 4 | 5 |
| 8 | A (10) | A (30) | A (40) | A (20) | A (10.0) | A (2.0) | 4 | 4 | 4 | 5 | 5 | 4 |
| Comp. Ex. | | | | | | | | | | | | |
| 1 | A (10) | A (20) | A (70) | — | A (7.0) | A (2.0) | 1 | 3 | 2 | 5 | 5 | 1 |
| 2 | A (35) | A (60) | — | A (5) | A (7.0) | A (2.0) | 5 | 5 | 5 | 2 | 2 | 5 |
| 3 | — | A (60) | A (17) | A (23) | A (10.0) | A (2.0) | 4 | 2 | 4 | 3 | 3 | 4 |
| 4 | A (20) | A (50) | A (25) | A (5) | — | A (2.0) B (7.0) | 3 | 1 | 2 | 4 | 4 | 3 |
| 5 | A (20) | A (50) | A (25) | A (5) | — | A (2.0) C (10.0) | 2 | 1 | 1 | 3 | 3 | 3 |
| 6 | Commercial two-cycle engine oil (low-smoke oil) - a | | | | | | 3 | 2 | 2 | 4 | 4 | 4 |
| 7 | Commercial two-cycle engine oil (low-smoke oil) - b | | | | | | 2 | 2 | 2 | 4 | 4 | 3 |
| 8 | Commercial two-cycle engine oil (mineral oil) - c | | | | | | 1 | 1 | 1 | 4 | 4 | 1 |
| 9 | Commercial four-cycle engine oil (SG, 10W-30) | | | | | | 1 | 1 | 1 | 4 | 4 | 1 |
| 10 | Commercial diesel engine oil (CD, SAE30) | | | | | | 1 | 1 | 2 | 5 | 5 | 1 |

*In each evaluation item, rankings 4 and above show performance conforming to the crank-chamber compression two-stroke cycle engine of the present invention.

Component (4)

A: Polybutenylaminophenol having the following chemical formula (2):

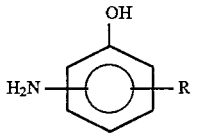

(2)

wherein R denotes an alkyl group with 12–84 carbon atoms derived from oligomers of isobutene, which is represented by the following chemical formula (3):

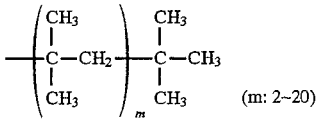

(3)

As apparent from the engine test results in Table 1, the lubricating oil compositions of Examples 1–8 according to the present invention exhibit very superior performance on all the evaluation items.

In contrast, Comparative Example 1, in which the content of Component (3) exceeds the scope of the present invention, yields very large amount of carbon deposition to the exhaust system, as compared with its corresponding Example 1, such that a piston ring sticking takes place.

Comparative Example 2, in which Component (3) is not contained, has problems in the lubricity at the small end of connecting rod and the crank bearings, as compared with its corresponding Examples 2, 4, 5, and 6.

Comparative Example 3, in which Component (1) is not contained, involves considerable deterioration in the prevention of piston ring sticking, as compared with its corresponding Example 7.

Comparative Examples 4 and 5, in which another ashless dispersant was used instead of Component (4) of the present invention, are considerably inferior in the piston ring sticking and the piston cleanliness, as compared with its corresponding Examples 2–6.

Comparative Examples 6 and 7, in which a commercially available low-smoke type two-stroke cycle engine oil (polybutene mixed), and Comparative Example 8, in which a commercially available mineral oil base two-stroke cycle engine oil (no polybutene mixed), are both considerably inferior in the piston ring sticking and the piston cleanliness, proving that they are unsuitable for two-stroke cycle cylinder injection engines of the present invention.

Comparative Example 9, in which a commercially available four-stroke cycle engine oil (SG, SAE10W-30), and Comparative Example 10, in which a commercially available cylinder injection engine oil (CD, SAE30), both result in a piston ring sticking, large amounts of carbon deposition, and considerably poor piston cleanliness, proving that they are unsuitable for two-stroke cycle cylinder injection engines of the present invention.

What is claimed is:

1. A lubricating oil composition consisting essentially of the following ingredients:

(A): a base oil containing (1) 10–30% by mass on the basis of a total amount of base oil of polybutene having number-average molecular weight of 250–350, (2) 30–60% by mass on the basis of the total amount of base oil of polybutene having a number-average molecular weight of 450–550, and (3) 15–40% by mass on the basis of the total amount of base oil of mineral oil and/or a synthetic oil other than polybutene, said component (3) having a kinematic viscosity of 2–35 $mm^2/s$ at 100° C.; and (B): 2–15 parts by mass based on 100 parts by mass of the base oil of an alkylaminophenol having an alkyl group with 8–400 carbon atoms.

2. The lubricating oil composition as claimed in claim 1, wherein said alkylaminophenol has the following formula:

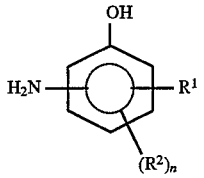

wherein $R^1$ is a straight-chain or branched $C_{12-300}$ alkyl group, $R^2$ is a straight-chain or branched $C_{1-3}$ alkyl group and n is 0 or 1.

3. The lubricating oil composition as claimed in claim 1, wherein said component (A) further contains a hydrocarbon solvent having a boiling point of 150°–350° C.

4. The lubricating oil composition as claimed in claim 2, wherein said component (A) further contains a hydrocarbon solvent having a boiling point of 150°–350° C.

* * * * *